US008974262B2

(12) United States Patent
Peterson

(10) Patent No.: US 8,974,262 B2
(45) Date of Patent: Mar. 10, 2015

(54) INFLATABLE WALKING APPARATUS

(71) Applicant: SDS Asia Limited, BVI #1748971, Hong Kong (CN)

(72) Inventor: Leroy L. Peterson, Omaha, NE (US)

(73) Assignee: SDS Asia Limited, BVI #1748971, Hong Kong (CN)

( * ) Notice: Subject to any disclaimer, the term of this patent is extended or adjusted under 35 U.S.C. 154(b) by 15 days.

(21) Appl. No.: 13/943,482

(22) Filed: Jul. 16, 2013

(65) Prior Publication Data

US 2014/0030943 A1 Jan. 30, 2014

(30) Foreign Application Priority Data

Jul. 24, 2012 (CN) ..... 2012 1 0258825
Jul. 24, 2012 (CN) ..... 2012 2 0361773 U

(51) Int. Cl.
*B63B 35/83* (2006.01)
*B63B 7/08* (2006.01)

(52) U.S. Cl.
CPC ..... *B63B 35/83* (2013.01); *B63B 7/082* (2013.01)
USPC ..... 441/76; 441/65; 441/66; 441/67; 441/78

(58) Field of Classification Search
CPC ..... B63B 35/83
USPC ..... 441/78, 76, 65–67
See application file for complete search history.

(56) References Cited

U.S. PATENT DOCUMENTS

| | | | | | |
|---|---|---|---|---|---|
| 2,267,254 | A * | 12/1941 | Reilley | 180/21 |
| 2,838,022 | A * | 6/1958 | Wilson | 441/78 |
| 3,428,015 | A * | 2/1969 | Cloud | 441/78 |
| 3,516,381 | A * | 6/1970 | Bobbitt | 441/78 |
| 3,905,323 | A * | 9/1975 | Kacere | 114/39.23 |
| 4,386,787 | A * | 6/1983 | Maplethorpe et al. | 280/206 |
| 5,417,598 | A * | 5/1995 | Stauffer | 440/100 |
| 5,921,834 | A * | 7/1999 | DeMasi | 441/78 |
| 8,499,862 | B2 * | 8/2013 | Mondl | 180/7.1 |
| 2004/0087224 | A1 * | 5/2004 | Hart | 440/21 |
| 2014/0030943 | A1 * | 1/2014 | Peterson | 441/76 |

* cited by examiner

*Primary Examiner* — Lars A Olson
*Assistant Examiner* — Jovon Hayes
(74) *Attorney, Agent, or Firm* — Suiter Swantz pc llo

(57) ABSTRACT

An apparatus for providing enhanced traction for an inflatable device is disclosed. The apparatus includes an inflatable gear assembly attachable to the inflatable device. The inflatable gear assembly defines an outside diameter that is greater than the largest cross-sectional distance of the inflatable device. The inflatable gear assembly and the inflatable device may be configured as totally integrated, partially integrated, or totally separated air chambers.

18 Claims, 6 Drawing Sheets

INFLATABLE WALKING APPARATUS

CROSS-REFERENCE TO RELATED APPLICATIONS

The present application claims priority based on Chinese Application No. 201210258825.4 filed Jul. 24, 2012, the disclosure of which is hereby incorporated by reference in its entirety.

The present application also claims priority based on Chinese Application No. 201220361773.9 filed Jul. 24, 2012, the disclosure of which is hereby incorporated by reference in its entirety.

TECHNICAL FIELD

The disclosure generally relates to the field of inflatable devices, particularly to an inflatable cylindrical float.

BACKGROUND

Various types of recreational aquatic activities have long been popular with children and adults alike. Floatation devices such as floating tubes and the like have been utilized in some of these activities. Some of these floatation devices may be inflatable. However, existing floating tubes provide limited maneuverability for the users. Therein lies a need for an inflatable device without these shortcomings.

SUMMARY

The present disclosure is directed to an apparatus. The apparatus includes a generally cylindrical airtight inflatable cylinder defined by an outer surface member and an inner surface member. The apparatus also includes a plurality of support structures disposed internally within the inflatable cylinder and a pair of airtight inflatable gears respectively disposed on two opposite ends of the inflatable cylinder. The outside diameter of each of the inflatable gears is configured to be greater than the outer diameter of the inflatable cylinder.

A further embodiment of the present disclosure is also directed to an apparatus. The apparatus includes an airtight inflatable chamber defined by an outer surface member and an inner surface member. The apparatus also includes a plurality of support structures disposed internally within the inflatable chamber and a pair of airtight inflatable gears respectively disposed on two opposite ends of the inflatable chamber. The outside diameter of each of the inflatable gears is configured to be greater than the largest cross-sectional distance of the inflatable chamber.

An additional embodiment of the present disclosure is directed to an apparatus for providing enhanced traction for an inflatable device. The apparatus includes an inflatable gear assembly attachable to the inflatable device. The inflatable gear assembly defines an outside diameter that is greater than the largest cross-sectional distance of the inflatable device.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
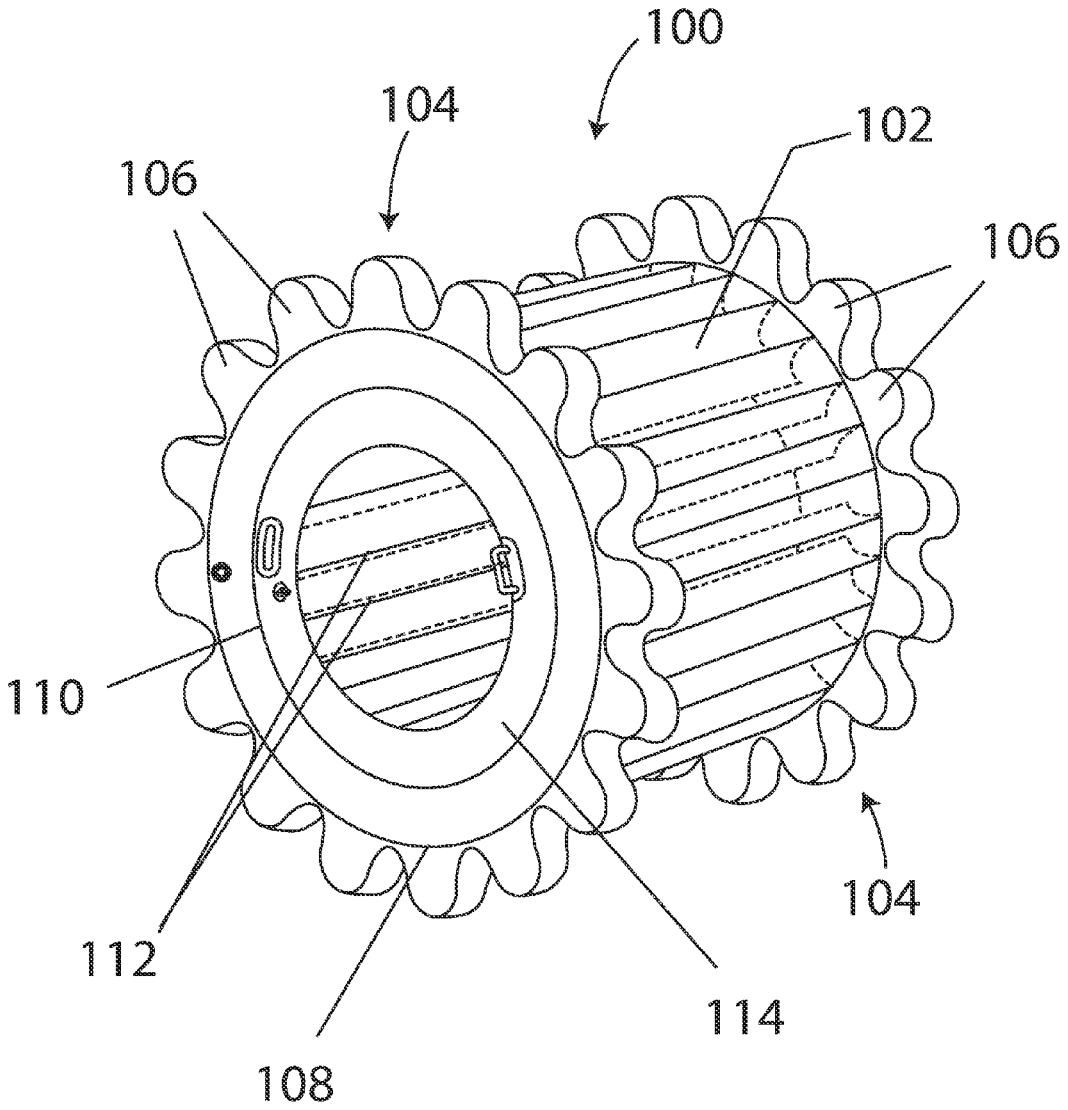
FIG. 1 is an isometric view of an inflatable walking apparatus in accordance with an embodiment of the present disclosure.
Figure 2:
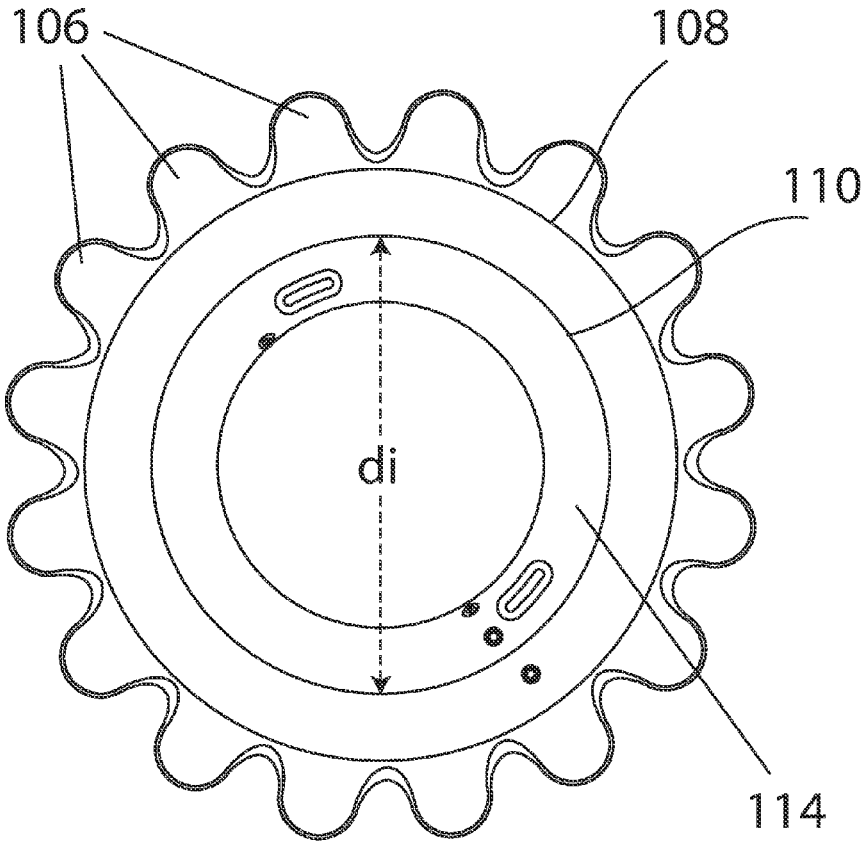
FIG. 2 is an end view of the inflatable walking apparatus depicted in FIG. 1.
Figure 3:
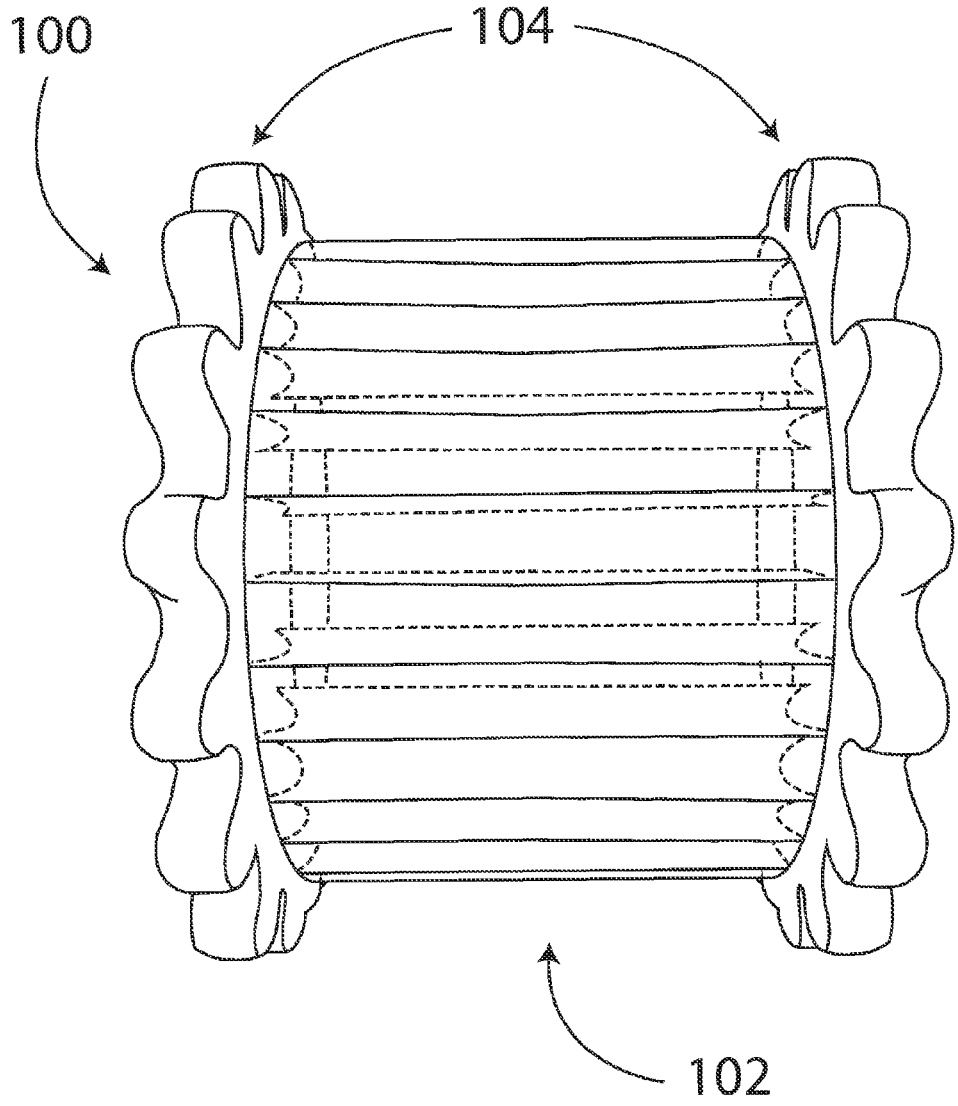
FIG. 3 is a side view of the inflatable walking apparatus depicted in FIG. 1.

Reference will now be made in detail to the subject matter disclosed, which is illustrated in the accompanying drawings.

The present disclosure is directed to an inflatable device that may be suitable for various aquatic activities. More specifically, the inflatable devices in accordance with the present disclosure allow users/riders to maneuver (e.g., walk forward or backward) on water.

Referring generally to FIGS. 1 through 6, an apparatus 100 including an inflatable cylinder 102 having a pair of inflatable gears 104 fixedly attached to the two ends of the inflatable cylinder 102 is shown. One or more riders can crawl and/or walk inside of the inflatable cylinder 102. As the rider(s) walk inside the inflatable cylinder 102, the inflatable gears 104 rotate/spin accordingly and the cogs 106 positioned on the inflatable gears 104 can propel the apparatus 100 forward or backward by catching the water as the apparatus 100 floats on water.

More specifically, in certain embodiments as depicted in the figures, the inflatable cylinder 102 is formed by an outer surface 108, an inner surface 110 and a plurality of parallel support structures 112 extending between the two ends of the inflatable cylinder 102. The inner and outer surfaces of the inflatable cylinder 102 may be the constructed using materials that are transparent or have windows that are transparent to let the rider(s) see through when operating the apparatus 100.

Figure 4:
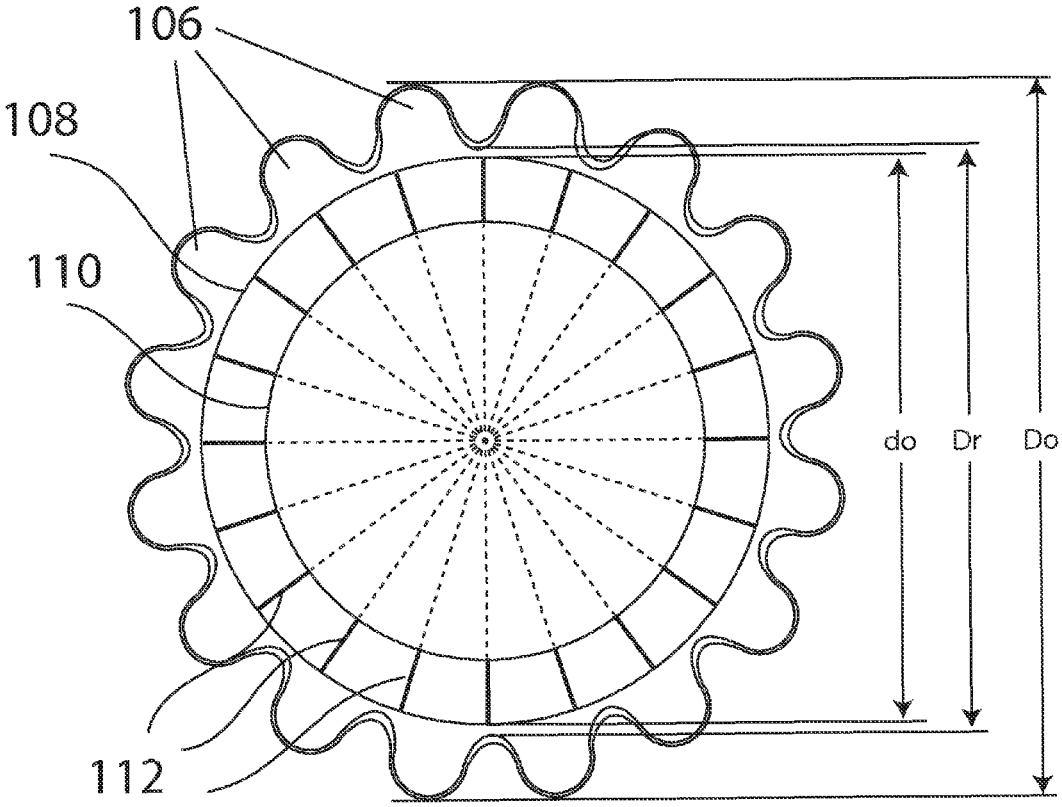
FIG. 4 is a cross-sectional view of the inflatable walking apparatus depicted in FIG. 1.
Figure 5:
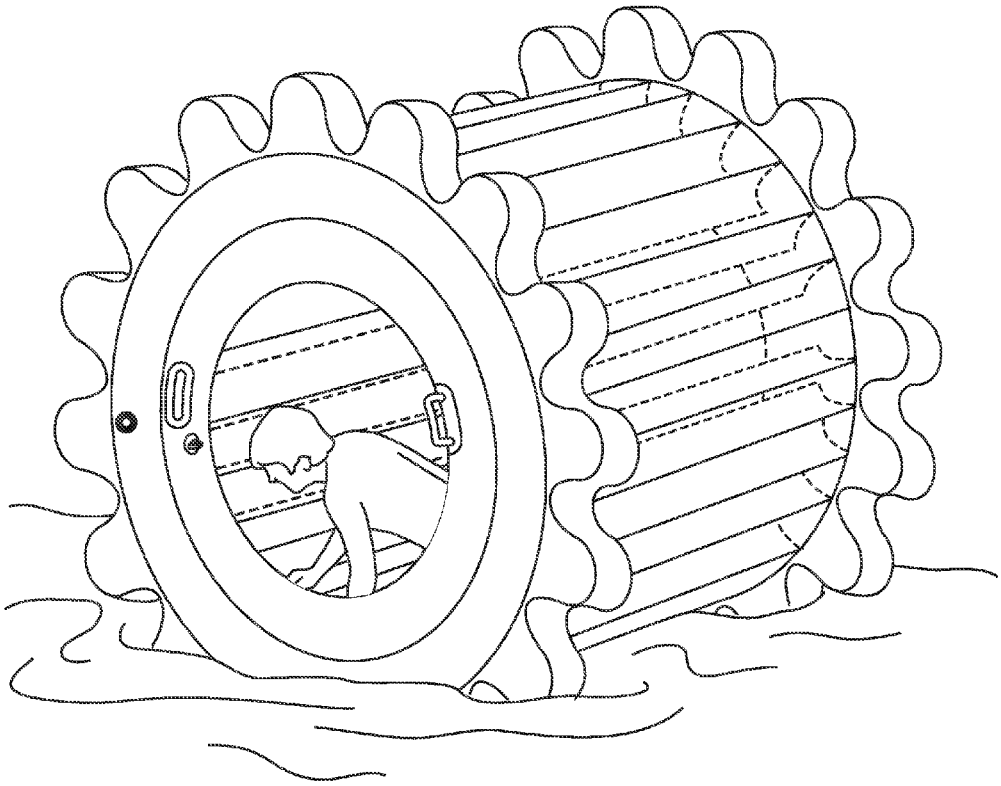
FIG. 5 is an illustration depicting one or more riders riding the inflatable walking apparatus.
Figure 6:
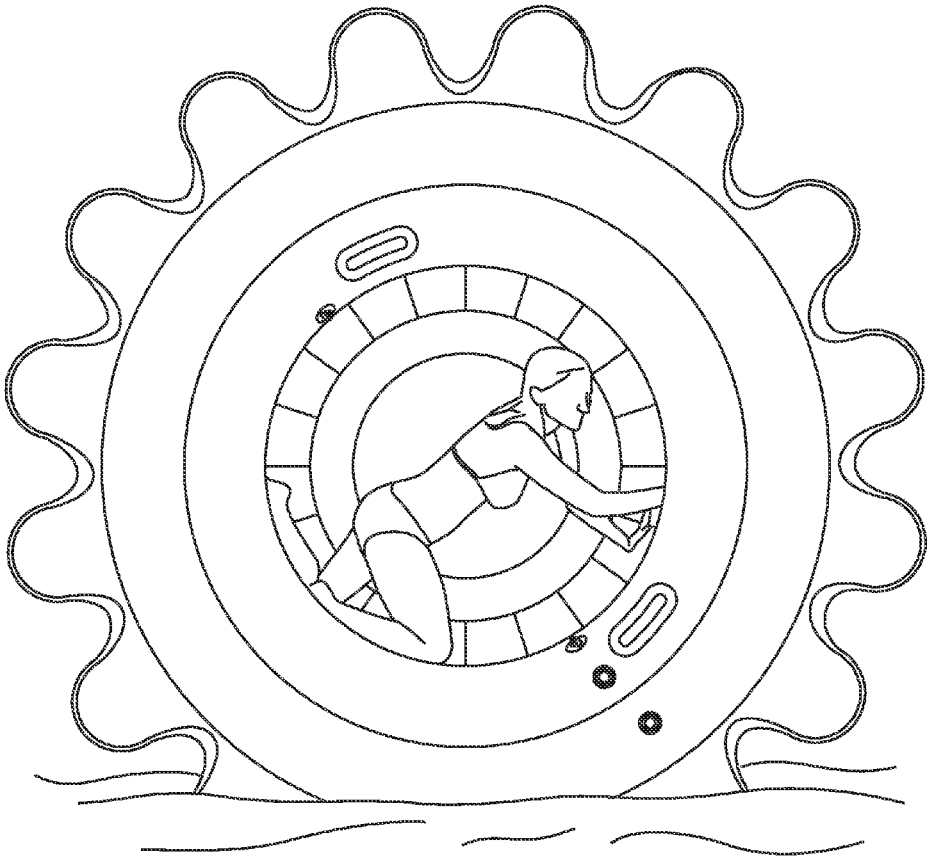
FIG. 6 is another illustration depicting one or more riders riding the inflatable walking apparatus.

As depicted in the cross-sectional view shown in FIG. 4, the support structures 112 may be radially distributed evenly within the inflatable cylinder 102. It is contemplated that each support structure 112 may include a plurality of air passages to allow air flow within the inflatable cylinder 102. For example, each support structure 112 may define multiple perforations/apertures to allow air flow within the inflatable cylinder 102. Additionally and/or alternatively, a space may be defined at each end of the support structure 112 so that air can work around the support structure 112. It is also contemplated that while the support structures 112 described above are configured as vertical beams (or I-beams), such a configuration is merely exemplary. Other types of support structures such as wave beams, X-beams or the like may also be utilized. Furthermore, instead of extending between the two ends of the inflatable cylinder 102, the support structures 112 may be configured to be parallel with or diagonally distributed between the two ends of the inflatable cylinder 102. In addition, other alternative support structures such as ropes or the like may be utilized without departing from the spirit and scope of the present disclosure.

To provide enhanced maneuverability for the rider(s), inflatable gears 104 are attached to the two ends of the inflatable cylinder 102. In accordance with the present disclosure, the outside diameter Do of the gear 104 (i.e., diameter of the gear measured from the tops of the cogs/teeth) is required to be greater than the outer diameter do of the inflatable cylinder 102. The root diameter Dr of the gear 104 (i.e., diameter of the gear measured from the base of the cogs/teeth), on the other hand, does not have any specific requirements. It is contemplated, however, that the root diameter Dr in certain embodiment generally coincides with or is slightly greater that the outer diameter do of the inflatable cylinder 102.

It is contemplated that the apparatus 100 may further include two guarding members 114 attached to the two ends of the inflatable cylinder 102. In one embodiment, each guarding member 114 is configured as an inflatable ring having an outer diameter that coincides with the inner diameter di of the inflatable cylinder 102. In a particular embodiment, the guarding member 114 is in the same general plane formed by the corresponding gear 104 positioned on that same end. The guarding members 114 are utilized to help prevent rider(s) from accidentally falling out of the cylinder 102 when riding. It is contemplated, however, that the configurations of the guarding members 114 are not limited to inflatable rings. Various other types of guarding members 114 such as nets, ropes, fabrics or the like may be utilized, as long as they allow the rider(s) to be able to get into or out of the inflatable cylinder 102.

It is also contemplated that the inflatable cylinder 102, the inflatable gears 104 and the guarding members 114 may be configured as totally integrated, partially integrated, or totally separated air chambers. Whether to configure the inflatable cylinder 102, the inflatable gears 104 and the guarding members 114 as totally integrated, partially integrated, or totally separated air chambers may be a design choice and may vary without departing from the spirit and scope of the present disclosure.

It is further contemplated that in certain embodiments the inflatable gears 104 may be configured to be removable from the cylinder 102. For instance, zippers may be utilized as the fastening mechanisms to attach/detach the gears 104 to/from the cylinder 102. It is understood that other types of fastening mechanisms may also be utilized. Exemplary fastening mechanisms may include, but not limited to, a rope connection system, a snapped connection system (e.g., using buttons or the like), a Velcro connection system, a buckled connection system, as well as other types of fastening mechanisms without departing from the spirit and scope of the present disclosure. Furthermore, it is contemplated that the gears 104 in accordance with the present disclosure may be configured to retrofit or custom fit to any existing inflatable devices to enhance their maneuverability. For instance, the inflatable gears 104 may be attached to wheels of a bicycle used on the water to enhance its traction on water.

It is noted that the inflatable gears 104 in accordance with the present disclosure protrude from the main body of the apparatus 100 and help give the apparatus 100 traction and allow the rider(s) to move the apparatus 100. While the ability to maneuver when the apparatus 100 floats on water is referenced in the examples above, it is contemplated that the apparatus 100 in accordance with the present disclosure may be utilize in various other types of surfaces such as on land, snow, ice or the like.

It is still further contemplated that the main body of the apparatus 100 is not limited to a cylindrical shape. Various different shapes may be utilized without departing from the spirit and scope of the present disclosure. That is, the main body of the apparatus 100 may be configured as any hollow chamber that allows one or more person to stand/kneel/sit inside and power the apparatus 100. It is also contemplated that external power sources may be applied to the apparatus 100. For instance, another device may push the apparatus 100 from the outside and the gears 104 will still allow the apparatus 100 to gain traction as they are designed to do so.

It is also noted that the inflatable feature of the gears 104 in accordance of the present disclosure allows the gears 104 to be deflated for storage. When deflated, the gears 104 may be folded or rolled-up, and therefore compact and easy to carry around.

The inflatable apparatus 100 in accordance with the present disclosure may be produced in several different size configurations. For instance, single-person or multi-person (e.g., 2, 3, 4 or 6 person) sizes may be produced for kids as well as adults. The inner diameter of the cylinder may vary from 36 inches to 72 inches depending on the specific size. For instance, for a 3 person model, the inner space defined by the cylinder may be approximately 87 inches in length and 76 inches in diameter. The cogs may be approximately 5 inches in width at tips and approximately 8 inches in width on the sides. While the specific dimension may vary from the example provided above, it is contemplated that if the cog is too narrow when fully inflated may not provide enough traction in the water, and on the other hand, if the cog is too wide when fully inflated may be too hard to spin by the riders.

The various components of the inflatable apparatus 100 in accordance with the present disclosure may be constructed using various types of materials. For instance, various types of flexible materials such as plastics (e.g., polyvinyl chloride, thermoplastic polyurethane, etc.) fabrics, or the like may be utilized. The inflatable apparatus 100 may be formed using one or more fabricated pieces joined together. The specific material and process utilized for producing the inflatable apparatus 100 may vary without departing from the spirit and scope of the present disclosure. In addition, due to the nature of the mat being inflatable, it is contemplated that certain corners/edges/sides may be rounded or curved when the inflatable apparatus 100 inflated.

While the descriptions above describe a standalone walking apparatus, the walking apparatus in accordance with the present disclosure may be connected together using certain fastening mechanisms. For instance, the a rope connection system, a snapped connection system (e.g., using buttons or the like), a Velcro connection system, a buckled connection system, as well as other types of fastening mechanisms may be positioned on the ends of the walking apparatus, allowing two or more of such walking apparatuses to be interconnected. It is contemplated that providing interconnectivity with other walking apparatuses may provide additional enjoyment to the riders and they may choose to connect as many apparatuses as they desired.

It is understood that the present disclosure is not limited to any underlying implementing technology. The present disclosure may be implemented using a variety of technologies without departing from the scope and spirit of the invention or without sacrificing all of its material advantages.

It is believed that the present disclosure and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus, comprising:

a generally cylindrical airtight inflatable cylinder, the inflatable cylinder defined by an outer surface member and an inner surface member;

a plurality of support structures disposed internally within the inflatable cylinder;

a pair of airtight inflatable gears respectively disposed on two opposite ends of the inflatable cylinder, an outside diameter of each of the inflatable gears is configured to be greater than an outer diameter of the inflatable cylinder when the inflatable cylinder and the pair of airtight inflatable gears are inflated; and a pair of guarding members respectively disposed on the two opposite ends of the inflatable cylinder.

2. The apparatus of claim 1, wherein at least a portion of the outer surface member and at least a portion of the inner surface member of the inflatable cylinder are transparent.

3. The apparatus of claim 1, wherein the entire outer surface member and the entire inner surface member of the inflatable cylinder are transparent.

4. The apparatus of claim 1, wherein a root diameter of each of the inflatable gears is configured to be equal to or greater than the outer diameter of the inflatable cylinder.

5. The apparatus of claim 1, wherein inflatable cylinder and the pair of inflatable gears form an integrated air chamber.

6. The apparatus of claim 1, wherein each of the inflatable cylinder and the pair of inflatable gears is a separate air chamber.

7. The apparatus of claim 1, wherein the inflatable gears are removably secured to the inflatable cylinder.

8. The apparatus of claim 1, wherein the guarding members are inflatable rings.

9. An apparatus, comprising:

an airtight inflatable chamber, the inflatable chamber defined by an outer surface member and an inner surface member;

a plurality of support structures disposed internally within the inflatable chamber;

a pair of airtight inflatable gears respectively disposed on two opposite ends of the inflatable chamber, an outside diameter of each of the inflatable gears is configured to be greater than a largest cross-sectional distance of the inflatable chamber when the inflatable chamber and the pair of airtight inflatable gears are inflated; and a pair of guarding members respectively disposed on the two opposite ends of the inflatable chamber.

10. The apparatus of claim 9, wherein a root diameter of each of the inflatable gears is configured to be equal to or greater than the largest cross-sectional distance of the inflatable chamber.

11. The apparatus of claim 9, wherein inflatable chamber and the pair of inflatable gears form an integrated air chamber.

12. The apparatus of claim 9, wherein each of the inflatable chamber and the pair of inflatable gears is a separate air chamber.

13. The apparatus of claim 9, wherein the inflatable gears are removably secured to the inflatable chamber.

14. The apparatus of claim 9, wherein the guarding members are inflatable.

15. An apparatus, comprising:

an airtight inflatable chamber, the inflatable chamber defined by an outer surface member and an inner surface member;

a plurality of support structures disposed internally within the inflatable chamber; and a pair of inflatable gears removably secured to the inflatable chamber, an outside diameter of each of the inflatable gears is greater than a largest cross-sectional distance of the inflatable chamber when the inflatable chamber and the pair of inflatable gears are inflated.

16. The apparatus of claim 15, further comprising:

a pair of guarding members respectively disposed on two opposite ends of the inflatable chamber.

17. The apparatus of claim 15, wherein the inflatable gear assembly and the inflatable device form an integrated air chamber.

18. The apparatus of claim 15, wherein the inflatable gear assembly and the inflatable device form separate air chambers.

* * * * *